US006723983B2

(12) United States Patent
Holle

(10) Patent No.: US 6,723,983 B2
(45) Date of Patent: Apr. 20, 2004

(54) HIGH THROUGHPUT OF LASER DESORPTION MASS SPECTRA IN TIME-OF-FLIGHT MASS SPECTROMETERS

(75) Inventor: Armin Holle, Oyten (DE)

(73) Assignee: Bruker Daltonik GmbH, Bremen (DE)

( * ) Notice: Subject to any disclaimer, the term of this patent is extended or adjusted under 35 U.S.C. 154(b) by 21 days.

(21) Appl. No.: 10/085,631

(22) Filed: Feb. 28, 2002

(65) Prior Publication Data

US 2002/0145110 A1 Oct. 10, 2002

(30) Foreign Application Priority Data

Mar. 1, 2001 (DE) ..... 101 09 917

(51) Int. Cl.[7] ..... H01J 49/40
(52) U.S. Cl. ..... 250/287; 250/281; 250/282
(58) Field of Search ..... 250/287, 281, 250/282

(56) References Cited

U.S. PATENT DOCUMENTS 5,625,184 A * 4/1997 Vestal et al. ..... 250/287
6,300,627 B1 * 10/2001 Koster et al. ..... 250/287
6,348,688 B1 * 2/2002 Vestal ..... 250/287
6,534,764 B1 * 3/2003 Verentchikov et al.

FOREIGN PATENT DOCUMENTS

GB 2 305 539 A 4/1997
GB 2 366 910 A 3/2002

OTHER PUBLICATIONS

W.C. Wiley and I.H. McLaren, The Review of Scientific Instruments, Time–of–Flight Mass Spectrometer with Improved Resolution, 1955, pp. 1150–1157, vol. 26, No. 12, Michigan.

* cited by examiner

*Primary Examiner*—Kiet T. Nguyen

(57) ABSTRACT

The invention relates to a time-of-flight mass spectrometer for acquiring spectra of either primary or daughter ions with high mass precision. All the periodic voltage pulse sequences used in the mass spectrometer—in the ion source, and any precursor ion selector or post-acceleration unit—are run continuously at a fixed base frequency, independently of whether a spectrum is being acquired in the relevant period, in order to avoid any disturbance of the electrical and thermal equilibrium. Ignition delay of the laser after triggering is controlled by switching the output of the clock pulse. The voltage pulse sequences, moreover—once again to avoid settling times—are to be designed in such a way that their voltages and delay times are entirely independent of the mass of the precursor ions. This feature can be achieved through appropriate forming of the delayed ion acceleration voltage pulse.

21 Claims, 1 Drawing Sheet

HIGH THROUGHPUT OF LASER DESORPTION MASS SPECTRA IN TIME-OF-FLIGHT MASS SPECTROMETERS

FIELD OF THE INVENTION

The invention relates to the operation and embodiment of a time-of-flight mass spectrometer for acquiring spectra of either primary or daughter ions with high mass precision.

BACKGROUND OF THE INVENTION

In biochemistry, it is not only the saving of time and money that makes it desirable to achieve a high analysis throughput: in many application fields, the instability of the samples makes it essential that analytic procedures are carried out rapidly. Whereas in combinatorial chemistry the saving in time when analyzing tens of thousands of samples may be the most significant factor, in proteomics it must be considered that the proteins of a proteome, following their (for example, gel-electrophoretic) separation, purification and other sample preparation processes, are susceptible to oxidative, thermal or other types of decomposition, since they are no longer protected by their former association with other proteins and by the environment of a biological solution. This means that the thousands of proteins constituting a proteome should be analyzed within 24 hours, if possible, and at most 48 hours following their separation.

It is thus not only desirable but essential to achieve a high sample throughput for biochemical analysis.

Nowadays mass spectrometers are used for many biochemical analyses, and in particular for protein analysis. Most of these are time-of-flight mass spectrometers, in which the samples are ionized by laser desorption. Although modem mass spectrometers of this type are fitted with sample inlet systems which permit a large number of samples (384, 764 or even 1536 samples, for instance) to be placed on the sample supports, diverse problems associated with the fast analysis of these samples still remain, and these problems hinder high analysis throughput. These problems include both technical difficulties associated with the mass spectrometers being used and with the procedures employed, as well as difficulties with the reproducible preparation of the samples for ionization.

In proteome research the highest priority is to identify the individual proteins as rapidly as possible, but then also to identify differences from proteins that are already known. The identification is usually achieved by measurement of the precise masses of the peptides generated by enzymatic (preferably tryptic) digestion. The mixture of digestion peptides is subjected to MALDI analysis and a so-called "fingerprint spectrum" is generated. A special search algorithm is then used to compare the list of precise masses measured with the contents of a protein sequence database, frequently already yielding definite identifications. If, however, uncertainties result from ambiguity, or from masses that do not precisely match, then the peptides in question are investigated using a daughter ion analysis, and as a rule this will provide unambiguous answers.

In the type of time-of-flight mass spectrometry most often used here, ions of an analyte substance are created in an ion source by means of a short laser pulse. The ions are accelerated to a high energy in a short acceleration path, sent through a field-free flight-section, and measured by a time-resolving ion detector. Since all the ions have the same energy, the flight time of the ions measured in this way permits the determination of the mass, m, of the ions, or, more precisely, their mass to charge ratio, m/z.

Note: for the sake of simplicity, in the following reference will only be made to the mass, m, even though in mass spectrometry always the mass to charge ratio, m/z, is measured, where z is the number of elementary charges carried by the ion. Since many methods of ionization, such as, for instance, the matrix assisted laser desorption and ionization (MALDI) that is preferably used here, predominantly produce ions with only a single charge (z=1), this distinction is of little practical relevance here.

Since a single MALDI process only generates relatively few ions, the mass spectrometric analysis of a sample based on MALDI requires the summation of between 50 and 200 individual spectra in order to obtain a useful sum spectrum. In other words, between 50 and 200 laser pulses must be separately applied, each generating ions which are independently measured as an individual spectrum for inclusion in the sum spectrum. The problems mentioned above now have three principal aspects:

Up to now, the complex sequence of voltage pulses described below, which must be triggered each by a laser pulse, is simply switched on for acquiring the spectra and switched off in order to prepare for the next sample analysis. The electrical and thermal equilibria will never really balance as a result. Only under painfully maintained equilibrium conditions, however, is it possible to accurately reproduce all the voltage pulses, and this in turn is critical for the quality of the spectra.

To acquire the spectra of daughter ions, it is at present necessary to readjust the ion source potentials between one sample and the next, and within one sample even for the several daughter ion spectra from different precursor ions, in order to achieve optimal mass resolution for the precursor ion selection. Each adjustment, however, again disturbs the equilibrium of the electronics.

The preparation of the samples on the sample supports must be so uniform, and so homogenous throughout the samples, that the process of the quasi-explosive evaporation and ionization of the samples by the laser pulse is entirely reproducible, so that the 50 to 200 individual spectra all have the same quality, and that there are no variations in the flight times. This is hard to achieve.

An almost obvious solution for the first problem would be to allow the sequence of voltage pulses to run periodically at some fundamental frequency. The sequence of pulses in the ion source (and in turn all the other sequences of pulses), however, is triggered by the laser pulse itself, in order to eliminate the relatively dramatic effects of the laser's slightly irregular ignition delay. For most lasers it is, on the other hand, inappropriate simply to allow the laser to operate continuously at a high pulse rate merely for the purpose of keeping the electronics in equilibrium. Not only might the samples on the sample support be damaged by the laser irradiation, but the laser itself only has a limited life time. The life time of the laser would be considerably reduced by such continuous operation. Thus the number of laser shots within the life time must be carefully budgeted, particularly when high sample throughput procedure is aimed for.

The ions generated by laser desorption frequently possess initial velocities that are not the same for all the ions. In order to achieve a high mass resolving power, velocity focusing by a Mamyrin ion reflector has become widely used, followed by a second field-free flight path. The ion reflector usually has two stages. In the first stage the ions are decelerated strongly, but in the second stage only gently. Faster ions penetrate further into the relatively weak linear deceleration field in the second stage of the reflector than do the slower ions, and therefore cover a greater distance. If the two deceleration fields have the correct relationship, this longer pathway compensates precisely for the higher flight speed, resulting in an increased mass resolution.

One of the most commonly used ion sources makes use of matrix assisted laser desorption and ionization (MALDI). The analyte molecules are embedded in a matrix substance, on a sample support plate. A pulse of laser light between 1 and 5 nanoseconds in length creates a cloud of molecules of both the matrix and analyte substance. The cloud expands adiabatically into the surrounding vacuum, giving the molecules in the cloud a greater spread of velocities. In this cloud, analyte molecules are continuously ionized by transfer of protons from the matrix ions, so that the analyte ions not only show a spread of velocities, their formation times are also spread.

A reflector is not able to focus this simultaneous spread of both speed and creation time. For this reason, a further method for improvement of mass resolution has been widely adopted for MALDI, comprising a delay in the acceleration. The basic principle behind the improvement in mass resolving power under conditions of pure energy spread has been known for more than 40 years. The method was published by W. C. Wiley and I. H. McLaren, "Time-of-Flight Mass Spectrometer with Improved Resolution", Rev. Scient. Instr. 26, 1150, 1955. The authors called the method "time-lag focusing" (TLF). It has been applied to MALDI ionization quite recently under a variety of names, such as "space-velocity correlation focusing" ("SVCF": U.S. Pat. No. 5,510,613; Reilly, Colby and King) or "delayed extraction" ("DE": U.S. Pat. No. 5,625,184; Vestal and Juhasz), and is also available in commercially available time-of-flight mass spectrometers.

The basic principle of this method is simple: the molecules and ions in the cloud are initially allowed to fly through a field-free region, without any electrical acceleration. This causes the faster molecules and ions to disperse further from the sample support electrode than do the slower ones, so that the speed distribution of the molecules and ions transforms to a spatial distribution. During this time, ionization by protons is also completed; those ions that are created from the molecules at a later time also demonstrate the same strict correlation of velocity and location. Only then is the acceleration of the ions switched on. The ions are accelerated by a homogenous acceleration field, with a linearly decreasing acceleration voltage. The faster ions are then more distant from the sample support electrode, which subjects them to a somewhat smaller acceleration voltage, and this gives them a rather lower final velocity for the drift region of the time-of-flight spectrometer than those ions that were initially travelling more slowly. If the time lag (or time delay) and the voltage drop (i.e. the strength of the accelerating field) are correctly chosen, then those ions that were initially slower, but which, following the acceleration, are travelling faster are able to catch up with those that were initially faster (but which, following acceleration, are travelling more slowly) at an adjustable location, the time-focus. This means that at this time-focus, the ions are dispersed with reference to mass, but those with the same mass are precisely focused in respect of the flight time.

Following removal of all the ions, the ion source potentials must be returned to the potentials required at the time of the next ionization process by the laser pulse.

In a linear time-of-flight mass spectrometer with no reflector, the time-focus is placed at the detector position through the selection of the delay time and the potential drop. In this way, a linear time-of-flight mass spectrometer achieves high mass resolution. Unfortunately, the time-focus depends slightly on the mass, so that the maximum resolution can only be achieved for one part of the spectrum, and is noticeably inferior in other parts of the spectrum.

A procedure has been published in patent DE 19638577 (Franzen) showing how it is possible to largely overcome the mass dependency of the time-focusing at the location of the detector in a linear mass spectrometer through modifying the accelerating field during time (pulse shaping), generating a good mass resolving power over the whole range of the mass spectrum. After the acceleration pulse has been switched on, the acceleration field is increased smoothly approaching a limit value. This procedure is referred to here as the procedure "with time-shaped acceleration pulse", or as "pulse shape focusing".

In a time-of-flight mass spectrometer with a reflector, the time-focus of the acceleration is placed between the ion source and the reflector (U.S. Pat. No. 5,654,545; Holle, Köster and Franzen). The velocity-focusing reflector is then adjusted in such a way that ions of the same mass that leave this time-focus at the same time but with slightly differing velocities are again focused on the detector with reference to their velocities. The focus length of the reflector for ions of different velocities again depends slightly on the mass of the ions. Using the process of pulse shape focusing described above, it is again possible here to give the mass spectrum a uniform resolution over the entire range of masses. However, the intermediate time-focus, located between the ion source and the reflector, is not at the same position for ions of different masses.

The reflector of the time-of-flight mass spectrometer can also be used for the investigation of daughter ions (also known as fragment ions), created by metastable or collisionally induced decomposition of particularly selected ions. This selected type of ions is known as the "parent" or "precursor" ion. Note: in the following text, mass spectra of ions that have not decomposed are referred to as "primary spectra", in contrast to the spectra of fragment or daughter ions. The primary spectra thus contain signals from all ions which can be used as the precursor ions, from which it is possible to generate daughter ion spectra.

In the MALDI ionization process, the ions in the vapor cloud generated by the laser pulse experience a large number of collisions, and this increases the internal energy of the ions by exciting internal oscillations. Depending on the energy density in the small focus area of the laser pulse, a greater or smaller number of these ions become "metastable", so that they decompose with a half-life in the order of a few microseconds; they decay when they are still in the first flight path of the mass spectrometer, which means that it is possible to detect the fragment ions in the mass spectrometer. Detection of fragment ions being thus generated in the mass spectrometer's first field-free flight path by the reflector of a time-of-flight spectrometer is known as the PSD method (PSD=post source decay). It is, however, also possible to pass the precursor ions through a cell filled with collision gas, to cause collisionally induced decomposition (CID), and to detect the CID fragment ions in the same way.

If fragment ions are created by decomposition of ions following acceleration, then all the fragment ions continue to fly with the same velocity, v, as their precursor ions, although because of their lower mass, m, they have less kinetic energy, $E_k=mv^2/2$. Due to their lower kinetic energy, they do not penetrate so far into the reflector's second deceleration field; they therefore return earlier, and can be separately measured, according to their mass, at the end of the second field-free flight path.

However, a two-stage reflector can only ever measure a restricted portion of the full spectrum of daughter ions. For a gridless reflector with energy and space angle focusing—otherwise a very useful device—it is therefore necessary to measure the daughter ion spectra in, for instance, a sequence of 14 spectrum segments, and then to piece the various segments together. This increases sample consumption and analysis time required to an unacceptable degree. A solution is offered in patent DE 19856014 (Holle, Köster and Franzen, U.S. Pat. No. 6,300,627), where the ions are subjected to post-acceleration through a sudden increase in the potential of the ions during their flight through a small potential cell (the daughter ion spectrum acquisition process with "potential lift").

In order not to superimpose the spectrum of the fragment ions of the desired parent ions by other "parent" ions and their decomposition products, it is necessary to deflect the undesired ions. For this purpose, an electrical deflection capacitor is used between the ion source and the reflector. A voltage applied to the capacitor plates generates a deflecting field, diverting the undesired ions and preventing them from reaching the ion detector. To permit passage of the desired ions the capacitor voltage is briefly removed, so that these ions can pass through undeflectedly. Once the ions have passed through, the voltage is switched on again, and further ions can no longer reach the detector. The mass resolution achieved by such a setup is in the region of R=60 to 80, which means that for ions with a mass in the region of 1,000 atomic mass units, the admission window is between 12 and 15 mass units wide.

The resolution can be greatly improved through bipolar switching, in which a positive deflection potential for the passage of the precursor ions that are to be selected is first switched to zero and then to a negative value. The resolution achievable in this way (in association with an appropriately designed capacitor) is around R=200 to 1,000, adequate for almost all applications. The unit supplying the deflecting field must therefore permit the deflecting field to be switched off within a very short period of time (a few nanoseconds) and then, after a predetermined interval (a few tens of nanoseconds) to be switched on again in the opposite direction. Between the spectrum acquisition processes, the voltage must be returned to the first polarity, so that each spectrum is acquired under the same conditions.

If the selector is to achieve high mass resolution, it is necessary for the time-focus of the delayed acceleration to be placed accurately within the selector. Because the location of the time-focus depends on mass, the parameters of the delayed acceleration (i.e. the delay period and, most importantly, the strength of the accelerating field) must be adjusted according to the mass of the ions that are to be selected, in order to achieve optimum resolution in the precursor ion selector. This is the second of the problems, mentioned briefly above, that still has to be solved.

The ion selector can select the ions in the first field-free flight path either before or after decomposition. As they decompose, the ions do not change velocity (at least not significantly), so that the precursor ions can be selected together with their daughter ions travelling at the same velocity.

The acquisition of daughter ion spectra is of particular significance in proteomics, in which the "fingerprint" spectra of peptide mixtures are initially acquired. The peptide mixtures are obtained through enzyme digestion of the protein under investigation. When required, and for confirmation, daughter ion spectra from selected digestion peptides may be measured. The digestion peptides from, for instance, tryptic digestion have lengths corresponding to between 500 and 4,000 atomic mass units.

As mentioned above, it is of great importance for the quality of the precursor ion selector that the focus of the delayed acceleration is located precisely within the precursor ion selector. Since, however, the method of delayed acceleration has a mass-dependent focus length, the parameters of the delayed acceleration, in other words the delay time and the accelerating field strength, must be adjusted in such a way that the time-focus for the ion mass to be selected (having, for instance, between 500 and 4,000 atomic mass units) is always located precisely within the precursor ion selector. This modification of the ion source potential and the switching time, however, again causes all the potentials to drift, and it is necessary to wait until equilibrium has once more been achieved. This makes a high sample throughput rate difficult.

It can thus easily be seen that a modern time-of-flight mass spectrometer has complicated electronics that must deliver and then reset a large number of synchronized voltage pulses, initially triggered by the laser. The ion source requires a mass-adjusted acceleration pulse (sometimes called ion extraction pulse) following a delay relative to the pulse of laser light, and a resetting of the voltages in addition to a continuously present main acceleration voltage. The ion selector needs bipolar switching and resetting under extremely precisely time control. The post-acceleration unit again uses precisely delayed voltage pulse switching, and a time-shaped acceleration pulse in addition to subsequent resetting. The requirements for precision in the switching times are extremely tight, and are of the order of fractions of a nanosecond. The requirements for reproducibility of the voltages are also extremely high; for critical voltages they are of the order of fractions of a volt. In the methods of operation used hitherto, there is a further difficulty created by the need to readjust the potentials of the ion source, depending on the masses of the precursor or ions, between one sample and the next.

It must further be possible to measure the flight times of the ions to within fractions of a nanosecond. This requirement places extremely high demands on the constancy of all the time delays, acceleration voltages and their pulse shapes. It is well known that thermal conditions of the voltage pulse supplies have effects both on the times and on the voltages. There are, however, also electrical effects in capacitors (resulting from the recovery of residual voltages) that disturb the reproducibility of electrical processes, if these are not repeated at precisely equal intervals.

The third problem area involves the homogenous and reproducible preparation of the samples for MALDI ionization. Modem procedures for MALDI time-of-flight mass spectrometry have accepted that samples will not be homogenous, and have attempted to solve the problems created in this way by reading every individual mass spectrum from the transient recorder, checking its quality, and only adding it to the sum spectrum if the quality is acceptably good. At the same time, the data from the poor quality spectra is fed back to assist control of the MALDI process. The feedback governs both the laser energy density and the selection of the point on the sample that is evaporated by the laser focus. The preparations are found to have "hot spots" that are particularly favorable for the spectrum measurements. The acquisition frequency for individual spectra, therefore, is limited to about 3 Hertz for spectrum transfer and evaluation. For future procedures with high sample throughput, this approach is of no use. Feedback may only be used in exceptional cases.

A solution to this problem is, however, in sight. In patent DE 197 54 978 (Schürenberg and Franzen), a method of preparation has been published wherein special sample supports have hydrophilic anchors within a hydrophobic environment, achieving samples with precise localization and controlled shape and a fine, crystalline structure. In combination with automatic application of the sample droplets by a pipette robot, it is possible to achieve remarkably homogenous sample preparation. Recipes and formulas must be observed with extreme precision here. Preparing samples in this way provides a basis for the acqusition of spectra with high sample throughput.

SUMMARY OF THE INVENTION

The invention makes use of ionization by laser desorption, in particular by matrix assisted laser desorption and ionization (MALDI), with improved resolution by delayed ion acceleration. There is a generation of daughter ions through decomposition after leaving the ion source (post source decay: PSD) or by impact fragmentation (collisionally induced decomposition: CID). The precursor and daughter ions are selected by a precursor ion selector, and post-acceleration of the ions before they reach the reflector may be employed.

A first basic idea of the invention is to constantly run the periodic sequence of voltage pulses on the acceleration electrodes in the ion source under the control of a clock generator running at a fixed basic frequency, irrespective of whether a spectrum is being acquired or not. For lasers which are switched off during non-acquiring pauses, this is done in such a way that if no spectrum is being acquired the clock generator will trigger the sequence of voltage pulses directly, but if a spectrum is to be acquired, it will trigger the laser, whose light pulse in turn triggers the voltage pulses. In this way it is possible to bridge pauses, without loss of thermic and electic equilibrium, and with no unnessessary diminishing of laser life time. Such pauses might arise from movement of the sample support when it is necessary to bring a new sample into the laser's focus location. It has been found that the tiny irregular phase differences of a few tens of nanoseconds, generated by the jitter of the laser, and even longer delays of a few microseconds, necessary to select the parent ions in the parent ion selector, can be neglected, because they do not affect the established equilibrium.

It is possible, for instance, for the clock generator to be set to a frequency that corresponds to the fastest pulse frequency of which the laser is capable, but it can also be set to a multiple of that frequency. For most MALDI procedures on temperature-sensitive samples, about 20 Hertz represents the upper limit for the pulse rate, as the samples will otherwise become overheated. The procedure could, however, also be used at significantly higher pulse rates, if these can be usefully applied.

The invention also makes it possible to decouple the frequency with which spectra are acquired from the basic frequency, when a spectrum is not acquired in every electrical period. If the base frequency, for instance, is 20 Hertz, then the frequency with which spectra are acquired can, for instance, be reduced to 10 or 5 Hertz, by using only every second or fourth period of the base frequency, should the sample or the measurement process require such a procedure. If the base frequency represents a multiple of the fastest laser pulse frequency, then intermediate levels that do not immediately equate to a reduction by a factor of two may also be set. It is also possible for electrical periods to be selected on an irregular basis for the acquisition of spectra. Individual or multiple periods can be omitted, should this be required for the purposes of fetching spectra from the transient recorder or the calculation of feedback adjustments.

Adjustments to the voltage during the acquisition of primary spectra, disturbing the equilibrium, can be avoided by pulse-shape focusing in accordance with DE 19638577. The time-focusing of all ion masses exactly at the location of the detector is achieved here, and this brings a uniformly good mass resolving power over the entire mass spectrum. This means that any adjustment of voltages in the ion source according to the particular samples can be avoided. The pulse-shape focusing process is therefore an essential precondition for high spectral throughput. It has been found that, in many cases, a relatively simple exponential function is sufficient (in particular when a central electrode is used, as in FIG. 1), in which the voltage of the acceleration pulse approaches a limit voltage exponentially. This kind of voltage curve can be achieved with a simple R-C network.

For the sake of a high throughput of spectral measurements it is also helpful to first measure the primary spectra of a large number of samples, preferably all the samples, on one sample plate, then to make the adjustments for the measurements of the daughter ion spectra, and then, if necessary for the purposes of analysis, to measure the daughter ion spectra of the samples. In order to be able to carry out this process, the primary spectra are passed immediately after being acquired (in real time, so to speak) to an expert system. This system determines the necessity of obtaining daughter ion spectra, and calculates the associated precursor ion masses to be used for the daughter ion spectra. The necessity is defined here in accordance with the analytic task.

The daughter ion spectra are measured by reducing the acceleration voltage in the ion source and introducing a pre-cursor ion selector and a post-acceleration unit, both of which are mounted between the ion source and the reflector. They can be removed from the path of the ions to acquire the primary spectra.

There remains, for the measurement of daughter ion spectra, the still unsolved problem of avoiding the adjustment of the ion source potentials from one daughter ion spectrum to the next. These are made necessary, because the daughter ions to be measured are derived from precursor ions that are different in each case, and the time-focus of each must be placed within the precursor ion selector.

It is therefore a further basic idea of the invention to make the location of the time-focus in the precursor ion selector independent of mass with the aid of a new mode of operation for the "pulse-shape focusing", which until now has always been aimed at achieving an even resolution across the entire spectrum. This means that the sequence of delayed, time-shaped acceleration pulses in the ion source can also be made to run in exactly the same way for the daughter ion spectra from one spectrum to another, without additional adjustment, independently of the mass of the precursor ion that is to be selected. This requires the acceleration pulse to have a voltage, rising with time, of a form to be determined experimentally, so that the focus position in the precursor ion selector becomes independent of mass. It has also been found here that a relatively simple exponential function is sufficient, in which the voltage of the acceleration pulse exponentially approaches a limit value. This voltage curve can also be achieved with a simple R-C network, whose time constant, however, is different from that required for the acquisition of primary spectra. Between acquisition the primary and the daughter ion spectra, it is therefore necessary to switch between the R-C networks.

The slight dependency of the reflector's focus length on the mass of the ions can be compensated for through an appropriately time-shaped acceleration pulse in the post-acceleration unit, as is basically described in patent application DE 100 34 074.1. Once again, this permits the voltage curves to be continuously repeated, without needing to make adjustments between spectrum acquisitions.

The shaped voltage pulses in the precursor ion selector and in the post-acceleration unit (the potential lift) are also allowed to run at the base frequency. For the selection of the masses, the flight time of the ions from the ion source to the precursor ion selector is the significant factor, thus the delay of the selector's passing window with reference to the start time of the ions from the ion source. This variation in the delay of the passing period, in comparison with the start time, is a small but precise phase shift in the sequence of the voltage pulses, and this can be implemented without significantly disturbing the electronic equilibrium. The phase shift is a matter of only a few microseconds compared with a basic clock generator cycle of, for instance, 50 milliseconds; it must, however, be possible to adjust the phase shift with nanosecond precision.

Similar considerations apply to the post-acceleration unit, with its rather complicated voltage pulse scheme; here again, only a small but precise phase shift is applied.

The reflector always remains at a constant potential.

It is not essential for the fragmentation of the precursor ions to be initiated by creating metastable ions in the MALDI process itself. It is also possible to fit a collision chamber filled with collision gas between the ion source and the precursor ion selector, or between the precursor ion selector and the post-acceleration unit. This will create daughter ions through impact fragmentation (CID= collisionally induced decomposition).

DETAILED DESCRIPTION

A particularly favorable embodiment here is directed at the special application field of proteomics, but a specialist can easily convert it to other applications.

Digestion peptide mixture samples of many proteins are each applied to a sample location on a sample support plate. The sample support may have the size of a microtiter plate with, for instance, 384 hydrophilic sample locations, each in a hydrophobic environment (DE 197 54 978 or U.S. Pat. No. 6,287,872, Schürenberg and Franzen). A precisely measured quantity of clean matrix substance for the subsequent MALDI ionization is added to each sample. The peptide mixture samples are obtained by enzymatic digestion of one protein each, for instance by tryptic digestion. The proteins are obtained, for instance, from the 2D gel-electrophoretic separation of a proteome, i.e., from all the proteins from one cell tissue type. Controlled drying of the pipetted peptide mixture sample droplets creates homogenous matrix crystal agglomerates that contain, embedded in the crystal structure, evenly distributed molecules of all the peptides from the digestion mixture.

The sample support plate is placed into the time-of-flight mass spectrometer. The primary spectra are now measured—these primary spectra are known as "fingerprint spectra" or "peptide maps" of the proteins, showing the masses of the individual digestion peptides.

Figure 1:
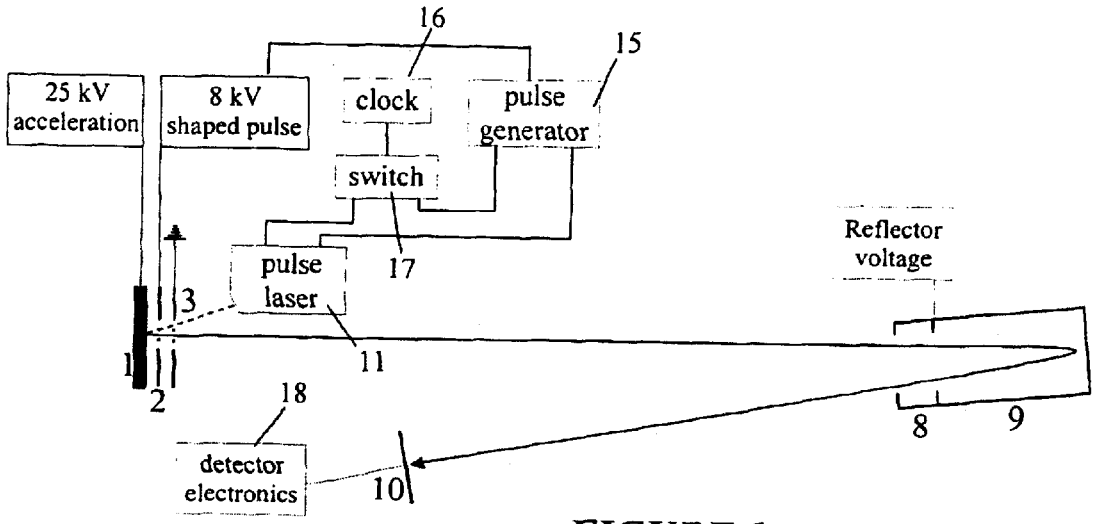
FIG. 1 illustrates an example of a time-of-flight mass spectrometer, set up to acquire primary spectra.

In FIG. 1, a large number of samples are located on a carrier plate (1). The carrier plate is at a constant potential of 25 kilovolts, the acceleration voltage. From laser (11), a brief laser pulse of about three nanoseconds In length creates a cloud of ions, which spread towards a central electrode (2). The central electrode (2) is at first also at the acceleration voltage. After a delay following the laser pulse, the potential of the central electrode (2) is changed, so that the ions are accelerated. The potential of the central electrode (2) is not, however, constant—a time-shaped acceleration pulse is applied to it, generated by pulse generator 15. The acceleration pulse causes the time-focus created by the delayed acceleration to be placed at the ion detector (10), independently of the mass of the ions. Having passed the central electrode (2), the acceleration of the ions towards the grounded base electrode (3) is completed. The accelerated ions now fly with a mass-dependent velocity through the first flight path to the reflector, in whose deceleration field (8) they are initially sharply decelerated. In the homogenous reflector field (9) they are velocity-focused, since the faster ions (not shown in the figure) penetrate a little bit further, and therefore have a slightly longer flight path, so that they stay longer in the reflector and cap catch up the slower ions, leaving the reflector somewhat earlier, precisely at the detector (10).

As mentioned above, a delayed, time-shaped acceleration pulse is applied to the first acceleration section of the ion source between the sample support plate (1) and the central electrode (2). The pulse is generated by pulse generator 15, which receives a signal from clock 16 when switch 17 is in the appropriate position. The pulse shape is chosen in such a way that an even, high resolution in the ion signal with good mass resolution is obtained across the whole spectrum, from the light to the heavy ion masses. The ions are generally accelerated here by a voltage between 20 and 30 kilovolts. The even resolution allows all the ion masses in the spectrum to be accurately determined from their flight time.

Figure 2:
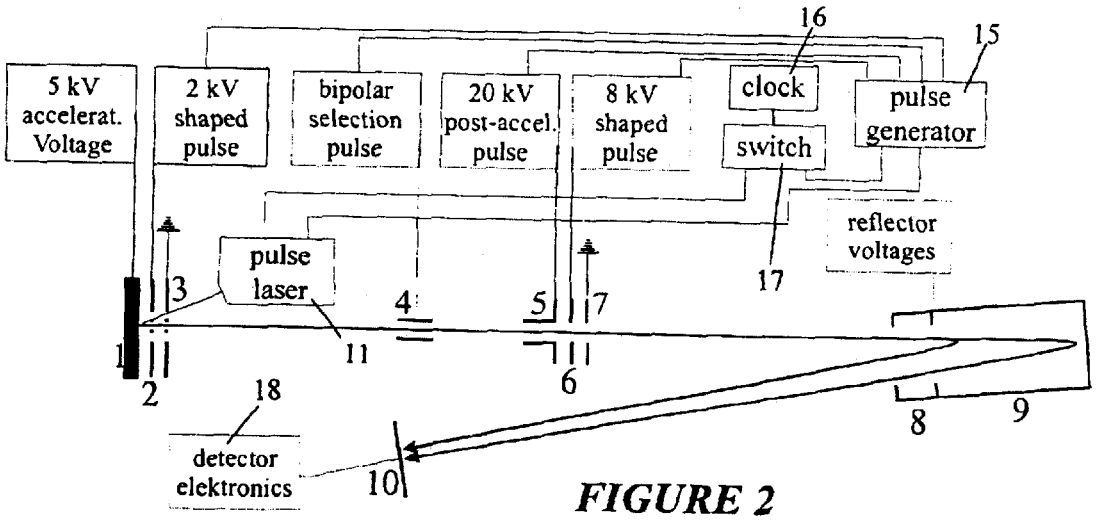
FIG. 2 shows the same time-of-flight mass spectrometer, but now it has been set up to acquire the daughter ion spectra from selected precursor ions.

FIG. 2 shows the same arrangement as FIG. 1, but in a configuration that allows the acquisition of daughter ion spectra from selected precursor ions. The sample support plate (1) is now at a much lower potential, only about 5 kilovolts. Once again, the laser pulse creates a cloud of ions, and these can spread freely into the space between the carrier plate (1) and the central electrode (2), because the central electrode (2) is initially at the same potential as the sample support plate (1). Here too, after a delay period, the potential of the central electrode (2) is changed. The effect of the delay period and the voltage is thus to place the time-focus for ions of one mass precisely in the precursor ion selector (4). The shape of the acceleration pulse ensures that this time-focus point is placed at the same location, independently of the mass. The potential on the precursor ion selector (4) initially deflects all the ions to one side, so that they can not reach the detector (10). As, however, the selected precursor ions (together with the daughter ions that have been created from them, and which fly with the same velocity) approach the selector, the deflection voltage is switched off. When the desired ions have passed through, the deflection voltage is re-applied in the opposite direction, so that as the ions fly away again, compensation is provided for deflections caused in the stray field as the ions approached. The precursor ions and their daughter ions now enter the potential lift (5). When they have entered, the potential of the lift (5) and of the central electrode (6) is raised by 20 kilovolts. The ions now pass the potential lift (5), and enter the space between the lift (5) and central electrode (6). A acceleration pulse is now applied to the central electrode (6), initiating the acceleration and resulting in time-focusing at the detector (10). The further acceleration takes place between the central electrode (6) and the base electrode (7). Shaping of the acceleration pulse makes the location of this time-focus independent of the mass. The reflector is now used as a daughter ion analyzer, because, in comparison with their precursors, the daughter ions have somewhat less energy, even not in full proportion to their lower mass because of the post-acceleration. This pauses all the daughter ions, from the smallest mass up to the mass of the precursor ions, being reflected in the reflector so that they can be acquired in one spectrum.

It has been found that for shaping the pulse for the accelerating field, an exponential function that approaches a limit value is highly effective. This exponential modification of the voltage between the sample support plate (1) and the central electrode (2) obeys the following function:

$$U_1=V_1\times\{1-\exp(-t/t_1)\}$$

where the acceleration voltage $U_1$ begins at time t=0 and approaches the limit value $V_1$ with a time constant $t_1$. This kind of exponential function can easily be generated with an electrical capacitor circuit (such as an R-C network, which might be part of the pulse generator 15 in the embodiments of FIG. 1 and FIG. 2), without the need for further complicated control. The optimum delay time, the optimum limit potential $V_1$ and the optimum time constant $t_1$ are determined experimentally.

It should be noted that the shaped acceleration pulse also causes the acceleration field strength between the central electrode (2) and the base electrode (3) to be modified over time, and it is only the interaction of the two acceleration sections, with their time-dependent accelerations that achieves the mass-independence of the focus length. The mass scale, which in a simple time of-flight mass spectrometer should be a linear relation between the mass and the square of the flight time, is slightly distorted by the initial velocity of the ions from the MALDI process and by the shaping of the acceleration pulse, and must therefore be found experimentally. This experimentally acquired calibration curve is used to calculate the masses from the flight times.

During the acquisition of these fingerprint spectra, the period of voltage pulses in the ion source is operated at a regular repetition frequency, independently of whether a spectrum is actually being acquired or not. The repetition frequency of the voltage pulse sequence is, for example, also retained when the sample support plate is being moved in order to bring a new sample of into the focus location of the laser without the laser sending UV light pulses. When the sample has arrived at the laser focus location, spectrum acquisition can begin. The output of the clock generator that triggered the potential period is now routed to trigger the laser. The laser fires, generates MALDI ions, and in turn triggers the sequence of voltage pulses in the ion source and the acquisition of the spectra by an integrating transient recorder. Each successive period of laser and voltage pulses yields an individual spectrum that is added to the existing sum spectrum. The result is a summed spectrum consisting of a preselected number, such as 50 or 100, individual spectra.

When spectrum acquisition has been completed for one sample, which might involve the acquisition and summing of 100 individual spectra, the trigger for the potential period is again provided by the clock generator directly. The summed spectrum is transferred to a computer for processing, while the next sample is moved to into the laser's focus location.

Meanwhile the summed spectrum, whose ion signals represent the flight times and intensities of the different types of ions, is processed into a list of ion masses and ion intensities by means of a calibration curve. The mass list is passed to an expert program (part of detector electronics 18) that attempts to identify the protein by searching spectral databases or protein sequence databases. If an unambiguous identification is not possible, or if there are any other uncertainties, caused for instance by a peptide that does not correspond to the expected mass, then the acquisition of daughter ion spectra for one or more peptides in this sample is earmarked. The expert program specifies those peptides from which daughter ion spectra are to be acquired.

When all the samples on the sample support plate have been measured, preparations are made for measurement of the daughter ion spectra. The fingerprint spectra of the digestion mixtures had been measured using very low laser energy densities, in order to cause the minimum possible degree of ion fragmentation. By varying the laser light attenuation in a controllable attenuator, the energy density at the focus is now increased in order to raise the number of metastable ion decompositions for the daughter ion spectra. The high acceleration voltage in the ion source is reduced to a low acceleration voltage, in the region of three to six kilovolts. The voltage supply to the ion source is switched to the new values for a delayed, time-shaped acceleration pulse. The time constant of the exponential function may, for instance, be changed by reconfiguring the R-C network.

The precursor ion selector and the post-acceleration unit are also moved into the path of the beam of ions. Because the grids in these units have a slight attenuating effect on the ion beam, they were removed from the ion path for the acquisition of the fingerprint spectra.

The periodic sequence of voltage pulses in the ion selector and in the post-acceleration unit are also switched on. Before acquisition of the daughter ion spectra, a few minutes are allowed to elapse, so that all the electronic supply units can reach their new electrical and thermal equilibrium. Only then is the acquisition of the daughter ion spectra from the first sample started.

Each time a daughter ion spectrum is acquired, the computer first decides which precursor ion mass is required for the next daughter spectrum. Delay calibration curves are used to find and to set the associated phase delays for the voltage pulses at the selector and at the post-acceleration unit. Only then is the sample moved into the laser focus location, so that acquisition can begin. This means that it is still possible to compensate for tiny imbalances that can result from the phase shifts.

The laser energy density, which is higher than it was for the fingerprint spectra, creates a significantly greater number of metastable ions in each laser pulse. These are ions that will decompose while within the mass spectrometer. Those ions that decompose after the acceleration section (1, 2, 3) but before the post-acceleration unit (5) can be detected as daughter ions. The higher ion density has some deleterious effect on the mass resolving power; however, since the mass resolution required for acquisition the daughter ion spectra is not as great as it is for fingerprint spectra, this is not a problem here.

Figure 3:
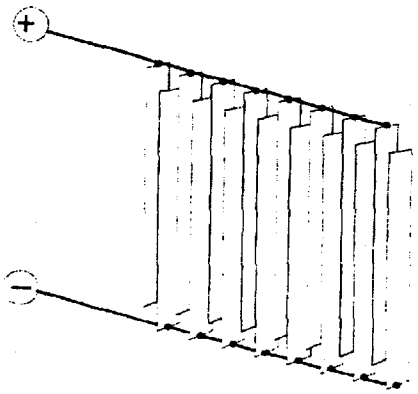
FIG. 3 shows an ion selector that has been designed as a capacitor grid according to Bradbury-Nielsen. This type of parent ion selector has lower stray fields before and behind the capacitor grid and shows higher mass resolution for the selection than a simple capacitor. The bipolar switching corrects for these residual stray fields and increases the resolution even more.

An optimal embodiment of a precursor ion selector (4) is based on a capacitor grid, arranged according to Bradbury-Nielsen (FIG. 3) and used instead of a simple capacitor in the time-of-flight spectrometer.

The voltage on the capacitor plates of this grid is switched off at a time $t_2$, just as the desired ions enter into the main deflection field of the individual, parallel deflection capacitors. The packet of desired ions is thus only deflected by the weak stray field in front of the capacitor. The voltage must be turned on again with the opposite polarity at a time $t_3$, just as the ions emerge again from the main deflection field. The slight deflection caused by the stray field as the ions arrive is then reversed by the stray field as they emerge again. Undesired ions, which may fly only a few tenths of a millimeter in front of or behind the desired ions, are subject to an overall deflection that prevents them from reaching the detector.

The selector (4) thus normally blocks the direct path of the ions. The ions are deflected slightly to the side, and can not reach the ion detector (10). At the moment when the ions that are to be selected (in our example, these are the ions of a specific peptide) arrive at the selector (4), the selector has just opened the straight passage by switching off the deflecting voltage. The precursor ions that have not decomposed, along with their daughter ions moving at the same velocity (and the uncharged fragments from which they have separated) now fly through the selector. Immediately after their passage, the selector (4) switches on the deflecting voltage with the opposite polarity, so blocking the straight passage again. If the time delay, the voltage and the special shape of the acceleration pulse in the ion source provide a time-focus to the ions just within the parent ion selector, the desired ions pass through the selector at the same time. This produces a high selectivity power.

The desired ions that have now been selected move on through another small field-free flight path into the post-acceleration unit. At the moment when their flight brings them into the small, enclosed space of the potential lift, the potential of this lift is raised very rapidly to a post-acceleration voltage. As they are leaving the lift they experience (between two or three grids) a post-acceleration, giving them an additional kinetic energy of, say, 20,000 electron Volts. If the onset of the post-acceleration is delayed, it is possible again to achieve time-focusing for ions of one mass between the lift (5) and the central electrode (6) for ions of one mass but with slightly different speeds. If the voltage pulse is shaped after onset, it is also possible here to make the focus length independent of the mass, thus achieving good mass resolution over the entire range of masses. If the acceleration in the ion source is 5 kilovolts, and the post-acceleration is 20 kilovolts, the daughter and precursor ions will now have kinetic energies between a minimum of 20 and a maximum of 25 kilovolts, depending on their mass. They can all be reflected by the reflector (8, 9) and measured in the detector (10) in a single spectrum measurement. The daughter ion spectrum thus contains all the daughter ions from the smallest mass up to that of the precursor ions. In general, good fingerprint spectra and good daughter ion spectra are obtained from 100 individual spectra each. At a basic spectrum repetition frequency of 20 Hertz, a single sum spectrum acquisition takes about five seconds. If we now assume half a second for moving the sample and for fetching the spectral data from the transient recorder, then each acquisition, regardless of whether it is a fingerprint spectrum or a daughter ion spectrum, needs about six seconds. If for each sample, precisely one fingerprint spectrum and on average two daughter ion spectra (from, on average, two different peptides) need to be measured, then the 384 samples on one sample plate require about two hours measurement time. If the sample support plates are loaded and removed automatically, then about 4,600 samples can be measured over 24 hours, involving the measurement of about 13,800 spectra.

The amount of analyte molecules in the individual sample preparations is usually sufficient for one primary spectrum and two or three daughter ion spectra. If the number of daughter ion spectra that has to be measured is greater, then it is helpful to apply a number of droplets from one sample material to separate hydrophilic anchors on one sample support plate.

It has been found that some sensitive samples cannot withstand exposure to increased laser energy density at a 20 Hertz repetition rate. The samples become too hot, and the sample in the MALDI preparation on the sample plate decomposes. In this case, the laser pulse rate can be reduced to 10 or 5 Hertz without having to change the base frequency of the potential period in the ion source, in the selector and in the post-acceleration unit. Reduction of the laser pulse rate has been described above.

It has been found that this kind of operation does not necessarily have an effect on the total duration of the acquire. A sample that needs the laser pulse frequency to be reduced to 10 Hertz also often supplies a higher yield of metastable ions; it is then sufficient to sum only 50 individual spectra, and the overall acquisition time remains the same. This does not, however, apply to every kind of sample.

One version of the measurement process for daughter ion spectra begins by only taking the sum of 10 individual spectra each. The quality of these initial sum spectra is then examined, and may be fed back to the control system, resulting, for instance, in a small change in the laser energy density. If this feedback process is carried out once or twice for each daughter ion spectrum, the acquisition time increases by about three seconds, and the number of samples drops from 4,600 to about 3,000 samples involving a total of 9,000 spectra measured in 24 hours. This still represents considerable progress compared to former feedback procedures, in which, with a acquisition frequency of 3 Hertz, 40 seconds were needed to acquire the sum spectrum.

One proteome contains perhaps 3,000 to 10,000 separable and detectable proteins. These proteins, however, are very sensitive to oxidation and decomposition, once they have been separated from each other, and must be analyzed if possible within 48 hours. If it is assumed that 24 hours are needed just for preparation of the samples, then this invention now permits a small number of mass spectrometers to be used in parallel to analyze such a proteome.

If the MALDI ion generation process does not itself provide sufficient metastability, the ions can also be fragmented optionally in a gas filled collision cell that can be located either between the base electrode (3) of the ion source and the precursor ion selector (4), or between the precursor ion selector (4) and the potential lift (5).

It is of course also possible for quite different embodiments of time-of-flight mass spectrometers, such as time-of-flight spectrometers with more than one reflector, to be fitted with electronics operating all pulse sequences continuously in accordance with the invention and using pulse-shape adjustments to achieve best focus conditions independently of mass, in accordance with the invention. Any specialist active in the field of mass spectrometry will be able to make such adaptations in the knowledge of this invention.

What is claimed is:

1. Method for the measurement of laser desorption mass spectra with high operational stability in a time-of-flight mass spectrometer with delayed ion acceleration, the method comprising the steps of:

(a) providing a time-of-flight mass spectrometer with a pulse generator that generates voltage pulses, in response to a pulse tripper signal, that are delivered to an electrode of the spectrometer for the control of the delayed ion acceleration;

(b) providing a pulse laser system that generates a laser pulse in response to a laser trigger signal, and that outputs a pulse trigger signal to the pulse generator once a laser light pulse is generated;

(c) generating a clock signal having a frequency corresponding to a frequency of spectrum acquisition or a multi pie thereof; and (d) directing the clock signal with a switch to either to the pulse laser system or to the pulse generator, the clock signal being directed to the pulse generator as a pulse trigger signal during waiting periods without spectrum acquisition, and being directed to the pulse laser system as a laser trigger signal at times of spectrum acquisition.

2. Method as in claim 1, wherein a uniform resolving power is maintained over the entire acquisition range of the mass spectrum through time-shaping the delayed acceleration voltage pulse in the ion source.

3. Method as in claim 1, further comprising using a precursor ion selector and a post-acceleration unit for the acquisition of daughter ion spectra, wherein the pulse generator controls a complete sequence of voltage pulses for the delayed acceleration electrode, the precursor ion selector and the post-acceleration unit.

4. Method as in claim 3, wherein a delayed acceleration voltage pulse from the pulse generator provides time-focusing of the ions of one particular mass precisely in the precursor ion selector, and wherein time-focusing of the daughter ions at the ion detector is made independent of the mass by time-shaping the delayed acceleration voltage pulse.

5. Method as in claim 4, wherein the time-shaping of the acceleration voltage pulses follows a simple exponential function approaching a limit value.

6. Method as in claim 5, wherein the time-shaped acceleration voltage pulse is applied to a central electrode positioned in front of a base electrode at chassis potential.

7. Method as in claim 5, wherein the time-shaping of the acceleration voltage pulse is created by simple R-C networks.

8. Method as in claim 3, wherein first the primary spectra of a large number of samples on a sample support are measured without using the precursor ion selector and the post-acceleration unit, the primary spectra from the samples being passed to an expert system that determines the necessity for acquisition daughter ion spectra and determines the associated precursor ions, and wherein the mass spectrometer is then readjusted for the measurement of daughter ion spectra, using the precursor ion selector and the post-acceleration unit and measures the daughter ion spectra from those samples where it has been found to be necessary.

9. Method as in claim 1, wherein only every second, third, or nth period of clock pulses is used to trigger the laser and thus to acquire a spectrum, whereas the remaining clock pulses trigger the pulse generator.

10. Method for the measurement of daughter ion spectra, the method comprising:

providing a reflector time-of-flight mass spectrometer having a precursor ion selector between an ion source and a reflector;

performing pulsed ionization of analyte substances on a sample support by laser desorption and supplying a time-shaped acceleration voltage pulses, switched on after a delay, to an acceleration electrode of the spectrometer wherein a time-focus for ions of a first mass created by the delay period and the accelerating field strength is located in the precursor ion selector; and raising over time the voltage of the acceleration voltage pulse, such that time-focus locations for ions of different masses are located at the same point, irrespective of the mass.

11. Method as in claim 10, wherein the voltage rise with time follows a simple exponential function approaching a limit.

12. Method as in claim 10, wherein the ions, having passed through the precursor ion selector, are further accelerated in a post-acceleration unit.

13. Method as in claim 12, wherein the ions are also accelerated in the post-acceleration unit by a time-shaped acceleration voltage pulse.

14. Method as in claim 10, wherein, in order to achieve and maintain electrical and thermal equilibrium in the supply units, the voltage pulse periods in the ion source are constantly repeated at a basic frequency, irrespective of whether a spectrum will be measured in the relevant period or not.

15. Method as in claim 14, wherein not every period of the basic frequency is used for ionization and for acquisition of a spectrum.

16. Method as in claim 10, wherein selection of the precursor ions for the acquisition of daughter ion spectra is achieved by changing only the phase between the voltage periods in the ion source and the precursor ion selector.

17. Method as in claim 10, wherein a deflecting field in the precursor ion selector is set to zero in order to permit passage of the desired ions, and after an appropriate switching time interval, is switched to the opposite field polarity.

18. Method as in claim 17, wherein the length of the switching time interval is chosen to be inversely proportional to the velocity of the desired ions.

19. A time-of-flight mass spectrometer in which the samples to be analyzed are ionized by laser desorption, comprising:

a pulse generator for generating an a acceleration voltage pulse;

a triggerable laser system connected to the pulse generator that, in response to the generation of a laser light pulse, initiates the generation of an acceleration voltage pulse from the pulse generator; and a clock for triggering the laser during spectrum acquisition periods, wherein the clock output can be switched between triggering the laser, for spectrum acquisition, and directly triggering the pulse generator, for periods where no spectra are acquired.

20. Time-of-flight mass spectrometer as in claim 19, wherein a precursor ion selector is provided, and wherein where the pulse generator generates a pulse that provides delayed triggering of the precursor ion selector.

21. Time-of-flight mass spectrometer as in claim 19, wherein a post-acceleration unit for daughter ions is provided, and wherein the pulse generator generates a pulse that provides delayed triggering of the post-acceleration unit.

* * * * *